US010976094B2

(12) United States Patent
Lee et al.

(10) Patent No.: US 10,976,094 B2
(45) Date of Patent: Apr. 13, 2021

(54) REFRIGERATOR HAVING A SWITCHABLE CHAMBER

(71) Applicant: LG ELECTRONICS INC., Seoul (KR)

(72) Inventors: Sanggyun Lee, Seoul (KR); Younseok Lee, Seoul (KR); Dongseok Kim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 176 days.

(21) Appl. No.: 16/217,742

(22) Filed: Dec. 12, 2018

(65) Prior Publication Data

US 2019/0178560 A1 Jun. 13, 2019

(30) Foreign Application Priority Data

Dec. 13, 2017 (KR) ..... 10-2017-0171650

(51) Int. Cl.
*F25D 11/02* (2006.01)
*F25D 17/04* (2006.01)
(Continued)

(52) U.S. Cl.
CPC ..... *F25D 17/045* (2013.01); *F25B 5/00* (2013.01); *F25B 41/043* (2013.01);
(Continued)

(58) Field of Classification Search
CPC ..... F25D 11/022; F25D 17/065; F25D 2317/061; F25B 2600/2511
See application file for complete search history.

(56) References Cited

U.S. PATENT DOCUMENTS 3,411,312 A * 11/1968 Sigl ..... F25D 17/065 62/180
5,765,388 A * 6/1998 Jeon ..... F25D 17/065 62/408

(Continued)

FOREIGN PATENT DOCUMENTS

| | | | |
|---|---|---|---|
| CN | 1201131 | A | 12/1998 |
| CN | 2655138 | Y | 11/2004 |
| CN | 107062669 | A | 8/2017 |
| CN | 107120905 | A | 9/2017 |
| DE | 102015200728 | A1 | 7/2016 |
| EP | 3104105 | A2 | 12/2016 |
| JP | 10332241 | A | 12/1998 |
| KR | 10-2009-0046251 | A | 11/2009 |

*Primary Examiner* — Jonathan Bradford
(74) *Attorney, Agent, or Firm* — Dentons US LLP

(57) ABSTRACT

A refrigerator includes a main body having a freezing chamber and a switchable chamber communicating with a refrigerating chamber through a duct, a compressor connected with a compressor suction path and a compressor discharging path, a condenser connected with the compressor discharging path and connected with a condenser discharging path, a switchable chamber evaporator, a freezing chamber evaporator connected with the switchable chamber evaporator through an evaporator connection path, a damper configured to control flow of cold air through the duct, a pair of switchable chamber capillary tubes connected with the switchable chamber evaporator, a bypass capillary tube connected with the evaporator connection path, a path switching device connected with the condenser discharging path, the pair of switchable chamber capillary tubes and the bypass capillary tube, and a controller for controlling the compressor, the damper and the path switching device.

17 Claims, 11 Drawing Sheets

(51) Int. Cl.

| | |
|---|---|
| ***F25D 17/06*** | (2006.01) |
| ***F25B 41/04*** | (2006.01) |
| ***F25B 41/06*** | (2006.01) |
| ***F25B 5/00*** | (2006.01) |

(52) U.S. Cl.
CPC ..... *F25B 41/067* (2013.01); *F25D 11/022* (2013.01); *F25D 17/065* (2013.01); *F25D 17/067* (2013.01); *F25B 2600/02* (2013.01); *F25B 2600/2503* (2013.01); *F25B 2600/2511* (2013.01); *F25D 2317/061* (2013.01); *F25D 2317/0671* (2013.01); *F25D 2317/0682* (2013.01); *F25D 2700/121* (2013.01); *F25D 2700/122* (2013.01)

(56) References Cited

U.S. PATENT DOCUMENTS

| | | | | |
|---|---|---|---|---|
| 6,055,826 | A * | 5/2000 | Hiraoka | F25D 17/065 62/408 |
| 2003/0024254 | A1* | 2/2003 | Yoshida | F25D 17/065 62/78 |
| 2007/0137230 | A1 | 6/2007 | Bae et al. | |
| 2013/0186129 | A1* | 7/2013 | Bae | F25B 41/067 62/498 |

* cited by examiner

REFRIGERATOR HAVING A SWITCHABLE CHAMBER

This application claims priority under 35 U.S.C. 119 and 365 to Korean Patent Application No. 10-2017-0171650, filed on Dec. 13, 2017 in the Korean Intellectual Property Office, the disclosure of which is incorporated herein by reference.

BACKGROUND

1. Field of the Disclosure

The present disclosure relates to a refrigerator, and to a refrigerator having a switchable chamber.

2. Discussion of the Related Art

A refrigerator is a device for cooling or storing objects (hereinafter, referred to as food) at a low temperature, such as foods from spoiling or going sour, and preserving medicines and cosmetics.

The refrigerator includes a freezing chamber in which food is stored and a freezing cycle apparatus for cooling the freezing chamber.

The freezing cycle apparatus may include a compressor, a condenser, an expansion device and an evaporator, in which refrigerant is circulated.

The refrigerator may include a freezing chamber maintained at a subzero temperature range and a refrigerating chamber maintained at a temperature range above zero, both of which may be cooled by at least one evaporator.

The refrigerator may include a switchable chamber having a temperature range varying according to a user desire, which may be formed independently of the freezing chamber and the refrigerating chamber. In this case, the switchable chamber may operate as a freezing chamber or a refrigerating chamber by user selection or may be maintained in a temperature range different from those of the freezing chamber and the refrigerating chamber.

An example of a refrigerator having a switchable chamber is disclosed in Korean Laid-Open Patent Publication No. 10-2009-0046251 A (published on May 11, 2009). Such a refrigerator includes a first evaporator for cooling a refrigerating chamber, a second evaporator for simultaneously or selectively cooling a freezing chamber and a switchable chamber, a cold air supply device for selectively suppling cold air generated in the second evaporator to the freezing chamber and the switchable chamber, and a first blowing fan for generating blowing force to forcibly circulate the cold air generated in the first evaporator to the freezing chamber.

The cold air supply device of the refrigerator includes a second blowing fan for selectively forcibly circulating the cold air generated in the second evaporator to the freezing chamber and the switchable chamber to generate blowing force and a damper for controlling an amount of cold air of the switchable chamber and the freezing chamber. The damper includes a first damper formed on a rear wall of the switchable chamber to control the amount of cold air in the switchable chamber and a second damper formed on a rear wall of the freezing chamber to control the amount of cold air in the freezing chamber.

SUMMARY

An object of the present disclosure is to provide a refrigerator capable of optimally controlling the temperature of a switchable chamber and rapidly cooling the switchable chamber.

To achieve the above objects, there is provided a refrigerator including a main body having a freezing chamber and a switchable chamber communicating with a refrigerating chamber through a duct, a compressor connected with a compressor suction path and a compressor discharging path to compress refrigerant, a condenser connected with the compressor discharging path and connected with a condenser discharging path, a switchable chamber evaporator configured to cool the switchable chamber, a freezing chamber evaporator connected with the switchable chamber evaporator through an evaporator connection path to cool the freezing chamber, a damper configured to control flow of cold air through the duct, a pair of switchable chamber capillary tubes connected with the switchable chamber evaporator, a bypass capillary tube connected with the evaporator connection path, a path switching device connected with the condenser discharging path, the pair of switchable chamber capillary tubes and a bypass capillary tube to guide the refrigerant flowing in the condenser discharging path to the pair of switchable chamber capillary tubes and the bypass capillary tube, and a controller configured to control the compressor, the damper and the path switching device.

The pair of switchable chamber capillary tubes may be connected with the path switching device and may be connected with the switchable chamber evaporator through a joint path.

The pair of switchable chamber capillary tubes may have the same capacity.

The duct may include a switchable chamber conduit communicating with the switchable chamber, a freezing chamber conduit communicating with the freezing chamber, and a refrigerating conduit communicating with the switchable chamber conduit and the freezing chamber conduit and communicating with the refrigerating chamber.

The duct may include a barrier formed between the switchable chamber conduit and the freezing chamber conduit to block flow of cold air between the switchable chamber conduit and the freezing chamber conduit.

The barrier may be spaced apart from the refrigerating chamber conduit and under the refrigerating chamber conduit in a vertical direction.

The barrier may have a horizontal width decreasing toward the top.

The barrier may have a cold air guide surface formed to become sloped gradually from the bottom and becoming steep toward the top.

Both surfaces of the barrier may be recessed.

One surface of the barrier may form a surface of the switchable chamber conduit to guide cold air of the switchable chamber to flow toward the refrigerating chamber conduit.

The other surface of the barrier may form a surface of the freezing chamber conduit to guide cold air of the freezing chamber to flow toward the refrigerating chamber conduit.

The path switching device may include a four-way valve including an inlet port connected with the condenser discharging path, a first outlet port connected with one of the pair of capillary tubes, a second outlet port connected with the other of the pair of capillary tubes, and a third outlet port connected with the bypass capillary tube.

The path switching device may be controlled to a plurality of modes, and the plurality of mode may include a simultaneous supply mode in which the path switching device guides refrigerant to the pair of switchable chamber capillary tubes, a single supply mode in which the path switching device guides refrigerant to any one of the pair of switchable chamber capillary tubes, and a bypass mode in which the path switching device guides refrigerant to the bypass capillary tube.

The controller may control the path switching device to the simultaneous supply mode when the refrigerator starts up or is coping with a high load.

The refrigerator may further include a switchable chamber fan configured to blow cold air of the switchable chamber to flow to the switchable chamber evaporator and to blow the cold air to the switchable chamber and to the duct and a freezing chamber fan configured to blow cold air of the freezing chamber to flow to the freezing chamber evaporator and to blow the cold air to the freezing chamber and to the duct.

The refrigerator may further include a switchable chamber temperature sensor configured to sense a temperature of the switchable chamber, a freezing chamber temperature sensor configured to sense a temperature of the freezing chamber, and a refrigerating chamber temperature sensor configured to sense a temperature of the refrigerating chamber, and the controller may control a speed of each of the switchable chamber fan and the freezing chamber fan based values sensed by the switchable chamber temperature sensor, the freezing chamber temperature sensor and the refrigerating chamber temperature sensor.

DETAILED DESCRIPTION OF THE PREFERRED EMBODIMENTS

Hereinafter, detailed embodiments of the present disclosure will be described in detail with reference to the accompanying drawings.

Figure 1:
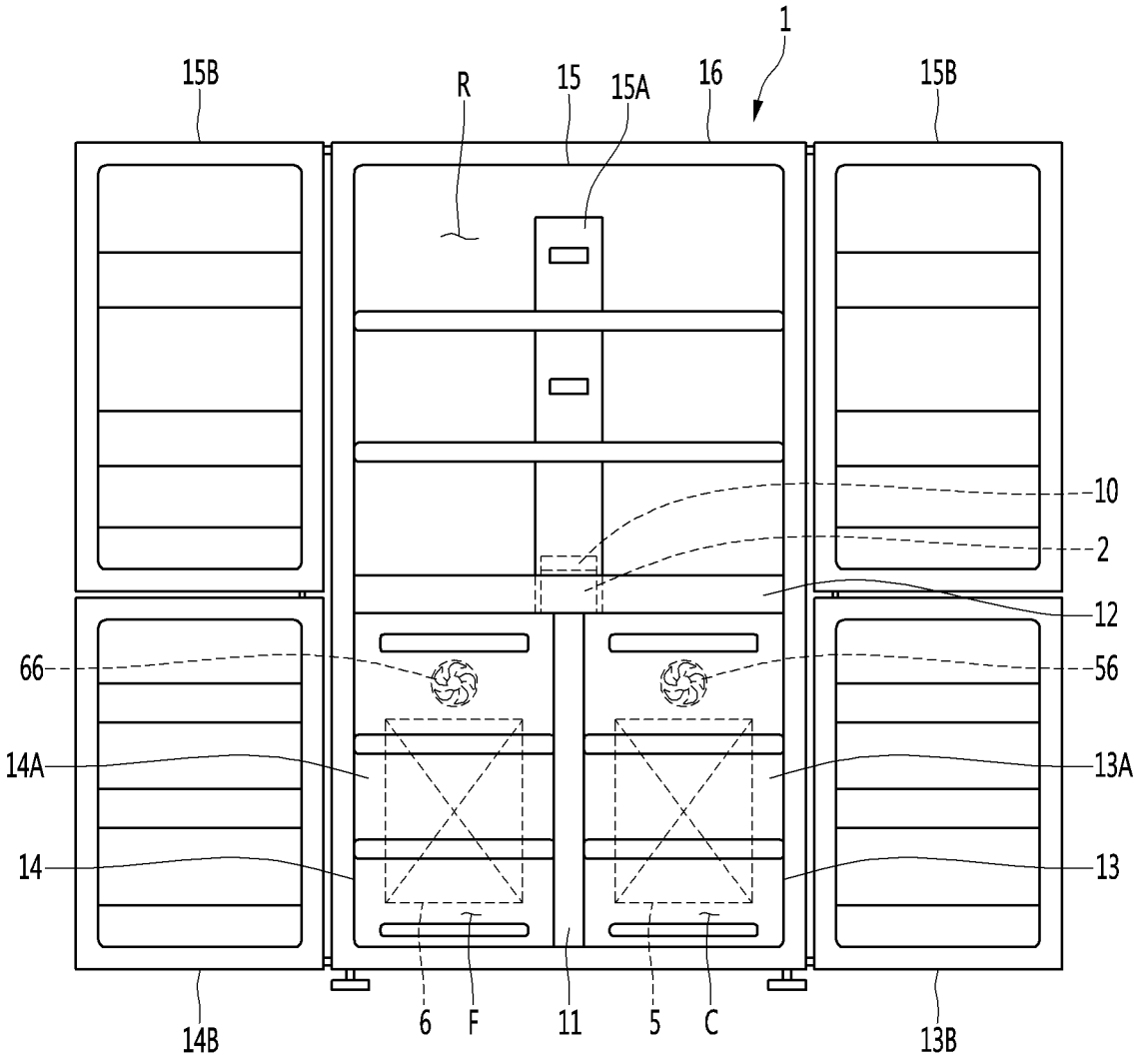
FIG. 1 is a diagram showing a configuration of a refrigerator according to an embodiment of the present disclosure.
Figure 2:
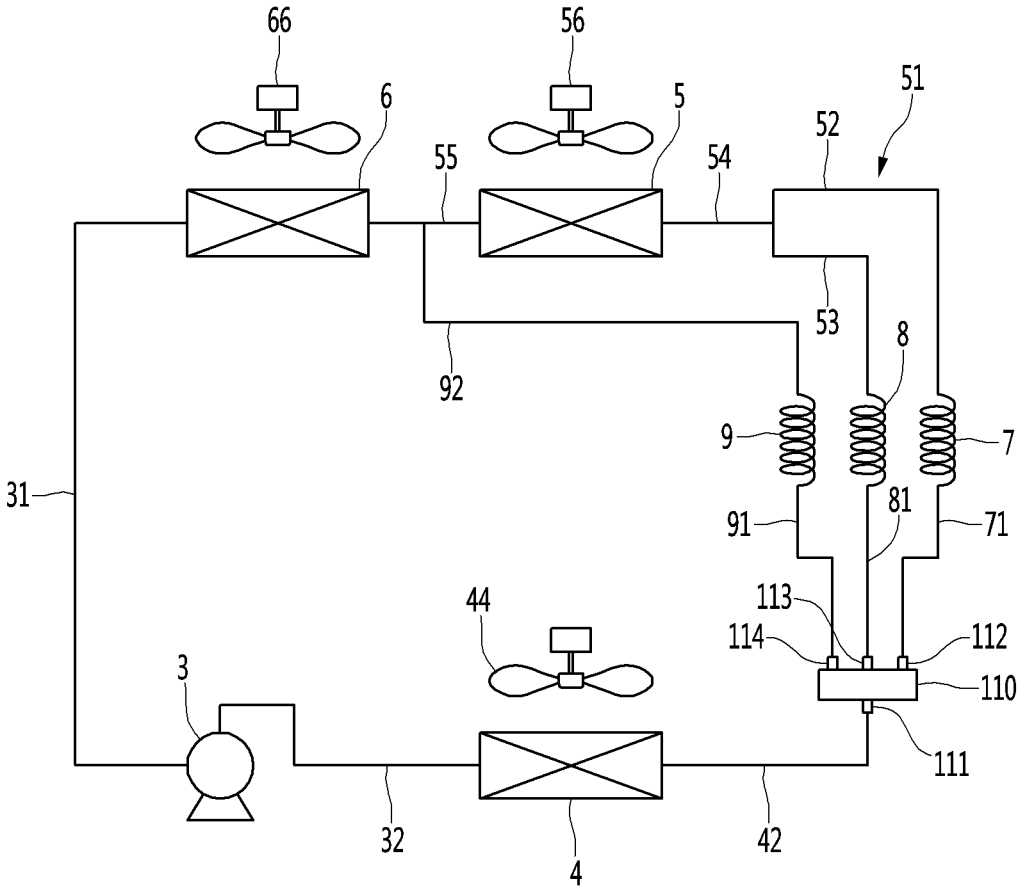
FIG. 2 is a cross-sectional view showing an inside of the refrigerator according to the embodiment of the present disclosure.
Figure 3:
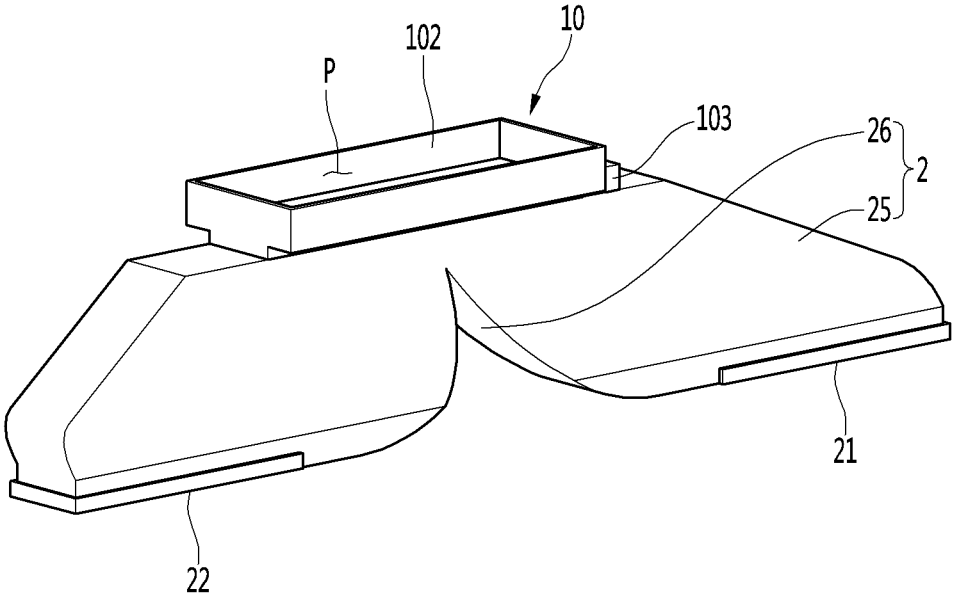
FIG. 3 is a perspective view showing a duct and a damper of the refrigerator according to the embodiment of the present disclosure.
Figure 4:
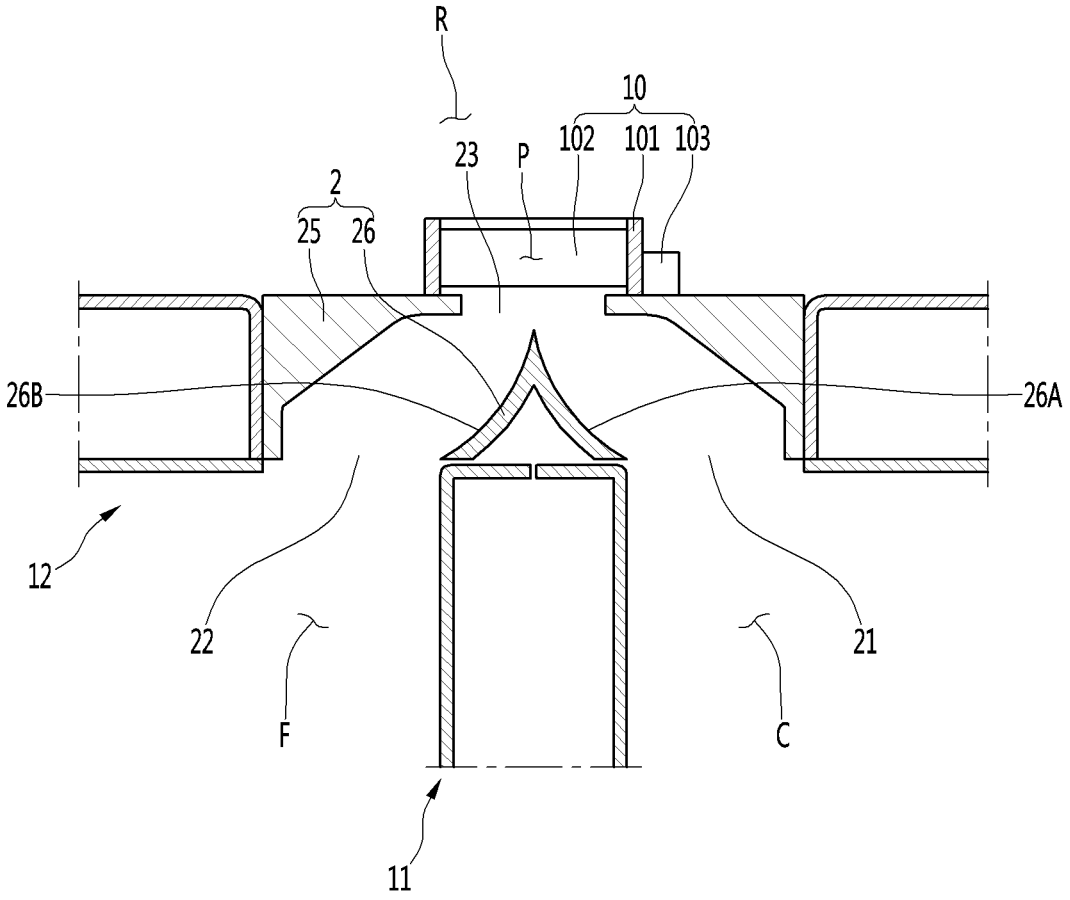
FIG. 4 is a view showing the duct and the damper when the damper of the refrigerator according to the embodiment of the present disclosure is opened.
Figure 5:
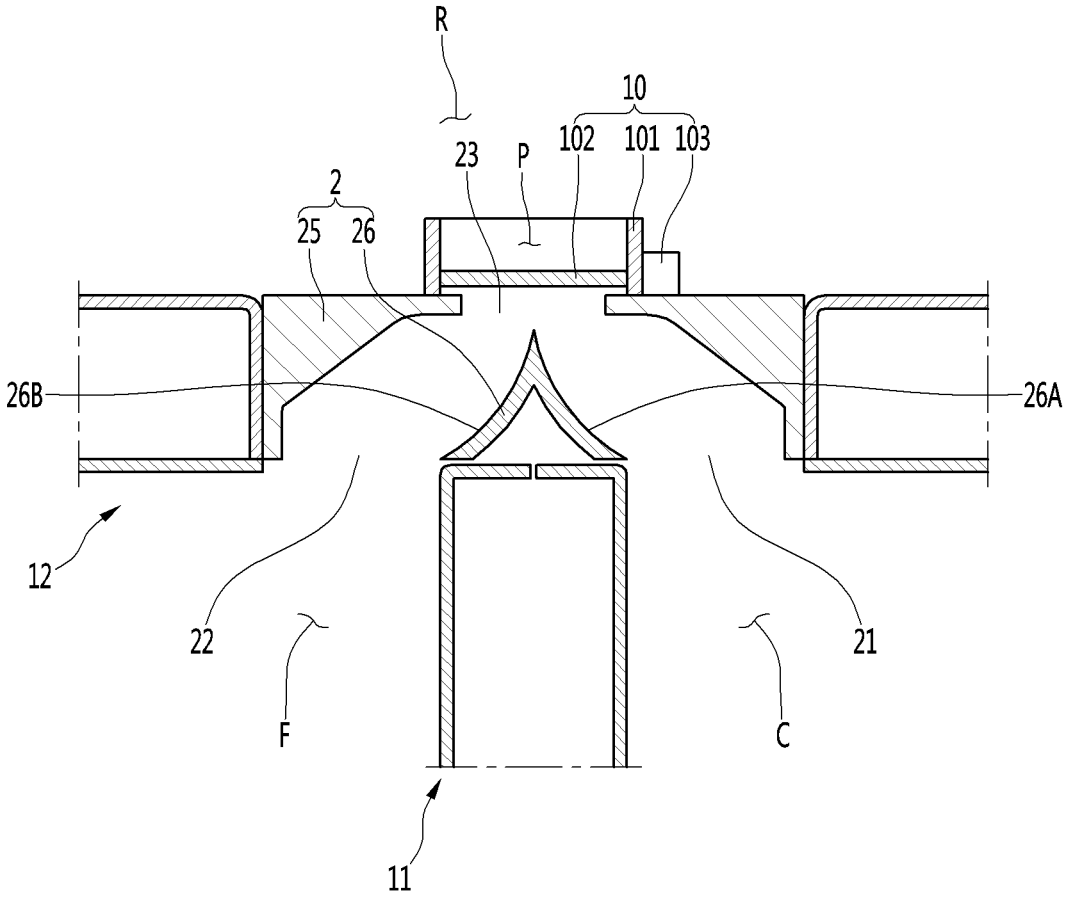
FIG. 5 is a view showing the duct and the damper when the damper of the refrigerator according to the embodiment of the present disclosure is closed.

FIG. 1 is a diagram showing a configuration of a refrigerator according to an embodiment of the present disclosure, FIG. 2 is a cross-sectional view showing an inside of the refrigerator according to the embodiment of the present disclosure, FIG. 3 is a perspective view showing a duct and a damper of the refrigerator according to the embodiment of the present disclosure, FIG. 4 is a view showing the duct and the damper when the damper of the refrigerator according to the embodiment of the present disclosure is opened, and FIG. 5 is a view showing the duct and the damper when the damper of the refrigerator according to the embodiment of the present disclosure is closed.

The refrigerator of the present embodiment includes a main body 1, a compressor 3, a condenser 4, a plurality of evaporators 5 and 6, a plurality of capillary tubes 7, 8 and 9 and a damper 10.

A plurality of storage chambers C, F and R may be formed in the main body 1. The plurality of storage chambers C, F and R may be partitioned by a plurality of barriers 11 and 12. The plurality of storage chambers C, F and R may include a freezing chamber F, a switchable chamber C and a refrigerating chamber R. The freezing chamber F, the switchable chamber C and the refrigerating chamber R may be partitioned by the plurality of barriers 11 and 12.

A user may operate an operation unit (not shown) to select a temperature range of the switchable chamber C, and the refrigerator may maintain the switchable chamber C at the temperature range selected by the user.

The switchable chamber C may be cooled to a temperature mode selected from among a plurality of temperature modes, the user may select one of the plurality of temperature modes, and the refrigerator may control the temperature of the switchable chamber C to the temperature range of the temperature mode selected by the user.

The temperature range of the switchable chamber C may be equal or similar to that of the refrigerating chamber R, may be equal to or similar to that of the freezing chamber F, or may be a specific temperature range between the temperature range of the refrigerating chamber R and the temperature range of the freezing chamber F.

Examples of the temperature range of the switchable chamber C may include a temperature range when food having a relatively low storage temperature, such as meat, is stored and a temperature range when food having a relatively high storage temperature, such as vegetables, is stored.

The refrigerating chamber R may be larger than each of the freezing chamber F and the switchable chamber C. The freezing chamber F and the switchable chamber C may be formed on the left and right sides of a vertical barrier 11, and the refrigerating chamber R may be formed above or below the freezing chamber F and the switchable chamber C.

The refrigerator may include a horizontal barrier 12 for separating the refrigerating chamber R from the freezing chamber F and the switchable chamber C.

If the refrigerating chamber R is formed at the upper side of the main body 1, the freezing chamber F and the switchable chamber C may be formed below the refrigerating chamber R. In contrast, if the refrigerating chamber R is formed at the lower side of the main body 1, the freezing chamber F and the switchable chamber C may be located above the refrigerating chamber R.

The main body 1 may include a switchable chamber inner case 13 forming the switchable chamber C, and a switchable chamber inner panel 13A in which a suction port and a discharging port are formed, and may be disposed in the switchable chamber inner case 13. The switchable chamber inner panel 13A may be disposed in the switchable chamber inner case 13 to cover a switchable chamber evaporator 5. The main body 1 may be connected with a switchable chamber door 13B for opening or closing the switchable chamber C.

The main body 1 may include a freezing chamber inner case 14 forming the freezing chamber F, and a freezing chamber inner panel 14A in which a suction port and a discharging port are formed, and may be disposed in the freezing chamber inner case 14. The freezing chamber inner panel 14A may be disposed in the freezing chamber inner case 14 to cover a freezing chamber evaporator 6. The main body 1 may be connected with the freezing chamber door 14B for opening or closing the freezing chamber F.

The main body 1 may include a refrigerating chamber inner case 15 forming the refrigerating chamber R, and a refrigerating chamber inner case panel 15A may be disposed in the refrigerating chamber inner case 15. Cold air introduced from a duct 2 may pass through the refrigerating chamber inner panel 15A, and the cold air guided into the refrigerating chamber inner panel 15A may be discharged to the refrigerating chamber. The main body 1 may be connected with at least one refrigerating chamber door 15B for opening or closing the refrigerating chamber R.

The main body 1 may include at least one return duct for guiding the cold air of the refrigerating chamber R to the switchable chamber C or the freezing chamber F. In the case a plurality of return ducts are disposed in the main body 1, a switchable chamber return duct (not shown) for guiding the cold air of the refrigerating chamber R to the switchable chamber C and a freezing chamber return duct (not shown) for guiding the cold air of the refrigerating chamber R to the freezing chamber F may be disposed in the main body 1.

Each of the freezing chamber F and the switchable chamber C may communicate with the refrigerating chamber R by at least one duct 2, and the at least one duct 2 may be a refrigerating chamber cold air supply duct for guiding the cold air of the switchable chamber C or the cold air of the freezing chamber F to the refrigerating chamber R.

For example, each of the freezing chamber F and the switchable chamber C may communicate with the refrigerating chamber R through a plurality of ducts. In this case, the plurality of ducts may include a first duct for allowing the freezing chamber F to communicate with the refrigerating chamber R and a second duct for allowing the switchable chamber C to communicate with the refrigerating chamber R, and the first duct and the second duct may be independently opened or closed.

In another example, the freezing chamber F and the switchable chamber C may communicate with the refrigerating chamber R through one duct 2. In this case, it is possible to minimize the number of parts of the refrigerator.

Hereinafter, an example in which the freezing chamber F and the switchable chamber C may communicate with the refrigerating chamber R with one duct 2 will be described.

However, the present disclosure is not limited to one duct 2 and the freezing chamber F and the refrigerating chamber R may communicate with each other through a first duct and the switchable chamber C and the refrigerating chamber R may communicate with each other through a second duct.

Referring to FIG. 4, the duct 2 may include a switchable chamber conduit 21 communicating with the switchable chamber C, a freezing chamber conduit 22 communicating with the freezing chamber F, and a refrigerating conduit 23 communicating with each of the switchable chamber conduit 21 and the freezing chamber conduit 22 and communicating with the refrigerating chamber R.

The duct 2 may include a duct body 25. The switchable chamber conduit 21, the freezing chamber conduit 22 and the refrigerating chamber conduit 23 may be formed in the duct body 25. The duct body 25 may be disposed in a duct accommodation hole formed in the horizontal barrier 12.

The duct 2 may include a barrier 26 for blocking flow of cold air between the switchable chamber conduit 21 and the freezing chamber conduit 22. The barrier 26 may be formed inside the duct body 25. The barrier 26 may be formed between the switchable chamber conduit 21 and the freezing chamber conduit 22.

The duct 2 may determine the amount of cold air flowing between the switchable chamber C and the freezing chamber F according to a height and shape of the barrier 26. The duct 2 may have a height and shape such that the amount of cold air flowing between the switchable chamber C and the freezing chamber F is not excessively large and may have a shape and height such that each of cold air flowing in the switchable chamber C and cold air flowing in the freezing chamber F are directed to the damper 10 as much as possible.

An upper end of the barrier 26 may face a bottom of the damper 10. The upper end of the barrier 26 may be formed to face a passage P of a path body 101 configuring the damper 10. If the height of the barrier 26 is too high, a possibility of interference between the barrier 26 and the damper 10 may be high, and, if the height of the barrier 26 is too low, the amount of cold air flowing between the switchable chamber C and the freezing chamber F may be excessively large. The barrier 26 may be spaced apart from the refrigerating chamber conduit 23 and under the refrigerating chamber conduit 23 in a vertical direction.

The barrier 26 may include cold air guide surfaces 26A and 26B for guiding cold air. The barrier 26 may have a horizontal width decreasing toward to the top. The cold air guide surfaces 26A and 26B may be formed to become sloped gradually from the bottom and to become steep toward the top.

Both surfaces of the barrier 26 may be the cold air guide surfaces 26A and 26B. Both surfaces 26A and 26*b* of the barrier 26 may be recessed. Both surfaces of the barrier 26 may maximally guide the cold air blown from the switchable chamber C and the freezing chamber F in a vertical direction. In this case, flow of cold air between the switchable chamber C and the freezing chamber F may be minimized.

One surface 26A of the barrier 26 may form the switchable chamber conduit 21, and the surface 26A may be recessed. The cold air of the switchable chamber C may be guided to the surface 26A of the barrier 26 to flow to the refrigerating chamber conduit 23.

The other surface 26B of the barrier 26 may form the freezing chamber conduit 22, and the other surface may be recessed. The cold air of the freezing chamber F may be guided to the other surface 26B of the barrier 26 to flow to the refrigerating chamber conduit 23.

The damper 10 may control flow of cold air through the duct 2.

The damper 10 may be disposed in the refrigerating chamber R or the duct 2. The damper 10 may include a path body 101, a damper body 102 and a driving device 103.

The passage P, through which air passes, may be formed in the path body 101. The damper body 102 may open or close the passage P of the path body 101. The driving device 103 may open or close the damper body 102. The driving device 103 may include a motor and may be connected to the damper body 102 directly or through at least one power transmitting member.

The path body 101 may be disposed in one of the refrigerating chamber R or the duct 2, and the damper body 102 may be rotatably connected to the path body 101, and the driving device 103 may be mounted to the path body 101 to rotate the damper body 102.

In the damper 10, the damper body 102 may be rotatably disposed in a refrigerating chamber inner case 15 or the duct 2 without a separate path body, and the driving device 103 may be mounted to the refrigerating chamber inner case 15 or the duct 2 to rotate the damper body 102.

In the open mode of the damper 10, as shown in FIG. 4, the damper body 102 may rotate in a direction for opening the passage 2 of the duct 2, and the cold air of the switchable chamber C or the cold air of the freezing chamber F may flow to the refrigerating chamber R through the duct 2.

In the open mode of the damper 10, the cold air of the switchable chamber C may flow into the switchable chamber conduit 21, pass through the refrigerating chamber conduit 23, and then pass through the damper 10. In addition, the cold air of the freezing chamber F may flow into the freezing chamber conduit 22, pass through the refrigerating chamber conduit 23 and then pass through the damper 10.

In the close mode of the damper 10, as shown in FIG. 5, the damper body 102 may rotate in a direction for closing the passage P of the duct 2. The cold air of the switchable chamber C and the cold air of the freezing chamber F are blocked by the damper 10 so as not to flow to the refrigerating chamber R.

The damper 10 may control the opening area of the passage P in multiple stages. In this case, the flow rate of cold air flowing from one of the switchable chamber C and the freezing chamber F to the refrigerating chamber R may be more precisely controlled.

The compressor 3 compresses refrigerant. The compressor 3 may be connected to a compressor suction path 31 and a compressor discharging path 32, and the compressor 3 may suck and compress the refrigerant of the compressor suction path 31 and then discharge the refrigerant to the compressor discharging path 32.

The condenser 4 condenses the refrigerant compressed in the compressor 3 and may be connected with the compressor discharging path 32. In addition, the condenser 4 may be connected with a condenser discharging path 42. The refrigerant of the compressor discharging path 32 may flow to the condenser 4 to be condensed while passing through the condenser 4, and the refrigerant, which has passed through the condenser 4, may be discharged through the condenser discharging path 42. The refrigerator may further include a condensing fan 44 for blowing air to the condenser 4. The condensing fan 44 may blow outside air of the refrigerator to the condenser 4.

The number of evaporators 5 and 6 may be less than the number of storage chambers formed in the main body 1. The plurality of evaporators 5 and 6 may be provided to respectively cool the storage chambers C and F.

The plurality of evaporators 5 and 6 may include a switchable chamber evaporator 5 for cooling the switchable chamber C and a freezing chamber evaporator 6 for cooling the freezing chamber F.

The switchable chamber evaporator 5 and the freezing chamber evaporator 6 may be connected in series. The switchable chamber evaporator 5 and the freezing chamber evaporator 6 may be connected through an evaporator connection path 55.

Refrigerant may pass through any one of the switchable chamber evaporator 5 and the freezing chamber evaporator 6, pass through the evaporator connection path 55 and pass through the other of the switchable chamber evaporator 5 and the freezing chamber evaporator 6.

The switchable chamber evaporator 5 may be located at an upstream side of the freezing chamber evaporator 6 in a refrigerant flow direction. In addition, the switchable chamber evaporator 5 may be connected with a pair of switchable chamber capillary tubes 7 and 8 by a joint path 51.

The joint path 51 may include a first path 52 connected to the first capillary tube 7 of the pair of switchable chamber capillary tubes 7 and 8, a second path 53 connected to the second capillary tube 8 of the pair of switchable chamber capillary tubes 7 and 8, and a common path 54 connected with the first path 52 and the second path 53. The common path 54 may be connected to the switchable chamber evaporator 5.

The refrigerator may further include a switchable chamber fan 56 for enabling the cold air of the switchable chamber C to flow to the switchable chamber evaporator 5 and then blowing the cold air to the switchable chamber C and the duct 2.

The freezing chamber evaporator 6 may be connected to the compressor 3 and the compressor suction path 31. Since the freezing chamber evaporator 6 is connected to the switchable chamber evaporator 5 in series, the freezing chamber evaporator 6 may exchange heat with the refrigerant evaporated while passing through the switchable chamber evaporator 5.

The refrigerator may further include a freezing chamber fan 66 for enabling the cold air of the freezing chamber F to flow to the freezing chamber evaporator 6 and then blowing the cold air to the freezing chamber F and to the duct 2.

The plurality of capillaries 7, 8 and 9 may include a pair of capillary tubes 7 and 8 connected to the switchable chamber evaporator 5 and a bypass capillary tube 9 connected to the evaporator connection path 55.

The refrigerator may include a path switching device 110 for switching the path of the refrigerant condensed in the condenser 4.

The pair of switchable chamber capillary tubes 7 and 8 may be connected to the path switching device 110.

The first capillary tube 7 of the pair of switchable chamber capillary tubes 7 and 8 may be connected to the path switching device 110 through a first inlet path 71, and may be connected to the switchable chamber evaporator 5 through the joint path 51. The first capillary tube 7 may be connected to the joint path 51 and, more particularly, to the first path 52.

The second capillary tube 8 of the pair of switchable chamber capillary tubes 7 and 8 may be connected to the path switching device 110 through a second inlet path 81, and may be connected to the switchable chamber evaporator 5 through the joint path 51. The second capillary tube 8 may be connected to the joint path 51 and, more particularly, to the second path 53.

The pair of switchable chamber capillary tubes 7 and 8 may have the same capacity.

The bypass capillary tube 9 may connect the path switching device 110 with the evaporator connection path 55. The bypass capillary tube 9 may decompress the refrigerant bypassing the switchable chamber evaporator 5 after being condensed in the condenser 4. The bypass capillary tube 9 may be connected to the path switching device 110 through a third inlet path 91. The bypass capillary tube 9 may be connected to the evaporator connection path 55 through an outlet path 92.

The path switching device 110 may be connected to the condenser discharging path 42, the pair of switchable chamber capillary tubes 7 and 8 and the bypass capillary tube 9. The path switching device 110 may guide the refrigerant flowing in the condenser discharging path 42 to the pair of switchable chamber capillary tubes 7 and 8 and the bypass capillary tube 9.

The path switching device 110 may be composed of a single valve or a combination of a plurality of valves. The path switching device 110 of the present embodiment may include one four-way valve. The path switching device 110 may include one inlet port 111 and three outlet ports 112, 113 and 114.

The path switching device 110 may include an inlet port 111 connected with the condenser discharging path 42.

In the path switching device 110, the first outlet port 112 connected to any one of the pair of capillary tubes 7 and 8, the second outlet port 113 connected to the other of the pair of capillary tubes 7 and 8, and the third output port 114 connected to the bypass capillary tube 9 may be formed.

The refrigerator of the present embodiment may be a dual capillary-serial bypass cycle in which the switchable chamber evaporator 5 and the freezing chamber evaporator 6 may be connected in series, the refrigerant may bypass the switchable chamber evaporator 5 to flow to the freezing chamber evaporator 6, and the dual capillaries 7 and 8 may supply a large amount of refrigerant to the switchable chamber evaporator 5.

The refrigerator of the present embodiment may control the temperatures of the three storage chambers C, F and R using one compressor 3, two evaporators 5 and 6, three capillary tubes 7, 8 and 9, two fans 56 and 66, the duct 2 and the damper 10.

Meanwhile, the refrigerator may include the same configuration as the embodiment of the present disclosure described immediately above, but one capillary tube is connected to the switchable chamber evaporator 5, instead of the pair of switchable chamber capillary tubes 7 and 8. However, in this case, since the refrigerant first passes through the switchable chamber evaporator 5 and then passes through the freezing chamber evaporator 6, the cooling capacity of the refrigerant may be significantly lost in the switchable chamber evaporator 5. The refrigerant having a relatively higher temperature than the switchable chamber evaporator 5 may flow into the freezing chamber evaporator 6, and the temperature of the freezing chamber F may slowly decrease. In addition, in a state in which the freezing chamber F is not sufficiently and rapidly cooled, the cold air of the freezing chamber F may flow into the refrigerating chamber R, such that the refrigerating chamber R may not be rapidly cooled.

In contrast, in the present embodiment, the refrigerator having the pair of capillary tubes 7 and 8 may supply a large amount of refrigerant through the pair of switchable chamber capillary tubes 7 and 8. When the refrigerator starts up or copes with a high load, the switchable chamber evaporator 5 may be rapidly cooled and sufficient cooling capacity may be provided to the freezing chamber evaporator 6.

Figure 6:
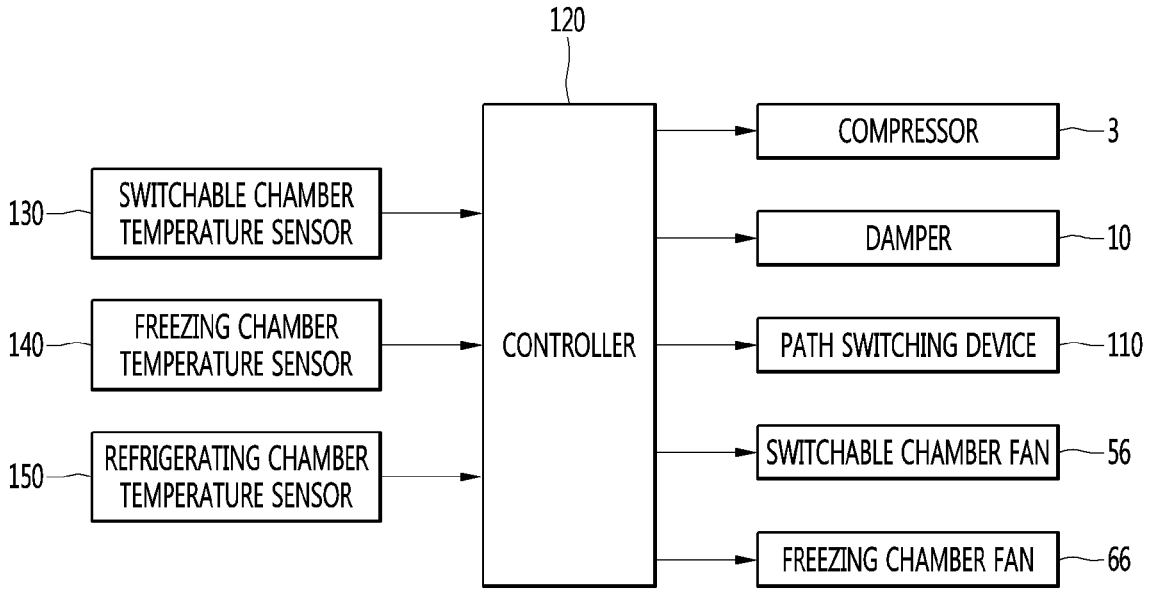
FIG. 6 is a control block diagram of the refrigerator according to the embodiment of the present disclosure.
Figure 8:
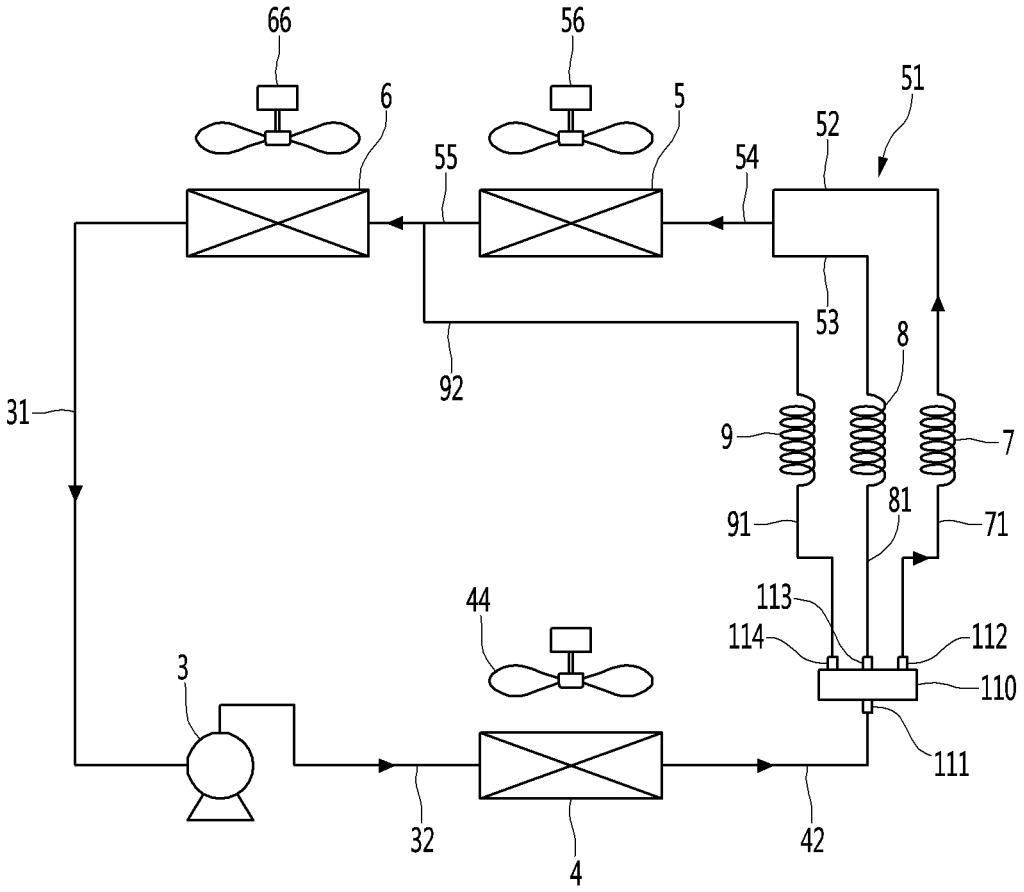
FIG. 8 is a view showing flow of refrigerant when the refrigerator according to the embodiment of the present disclosure is in a single supply mode.
Figure 9:
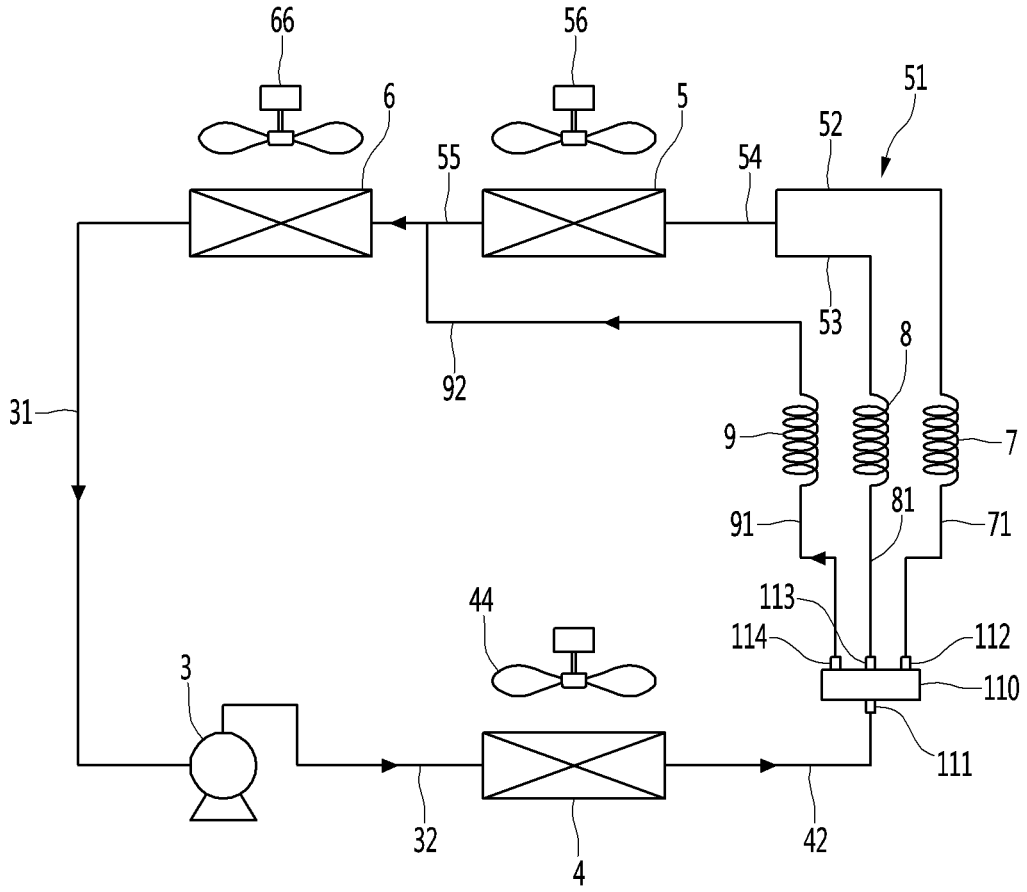
FIG. 9 is a view showing flow of refrigerant when the refrigerator according to the embodiment of the present disclosure is in a bypass mode.

FIG. 6 is a control block diagram of the refrigerator according to the embodiment of the present disclosure, FIG. is a view showing flow of refrigerant when the refrigerator according to the embodiment of the present disclosure is in a simultaneous supply mode, FIG. 8 is a view showing flow of refrigerant when the refrigerator according to the embodiment of the present disclosure is in a single supply mode, and FIG. 9 is a view showing flow of refrigerant when the refrigerator according to the embodiment of the present disclosure is in a bypass mode.

The refrigerator may include a controller 120 for controlling the compressor 3, the damper 10 and the path switching device 110. The controller 120 may be an electronic circuit including a microprocessor, an electronic logical circuit, or a custom integrated circuit. In addition, the refrigerator may further include a switchable chamber temperature sensor 130 for sensing a temperature of the switchable chamber, a freezing chamber temperature sensor 140 for sensing a temperature of the freezing chamber, and a refrigerating chamber temperature sensor 150 for sensing a temperature of the refrigerating chamber.

The controller 120 may control the damper 10 according to the temperature of the refrigerating chamber sensed by the refrigerating chamber temperature sensor 150.

The controller 120 may close the damper 10 if the temperature of the refrigerating chamber is in a satisfactory range, and open the damper 10 if the temperature of the refrigerating chamber is in a dissatisfactory range.

According to the present embodiment, the satisfactory range of the temperature of the refrigerating chamber may be a temperature range between a lower-limit temperature (target temperature−1° C.) of a target temperature of the refrigerating chamber and an upper-limit temperature (target temperature+1° C.) of the target temperature of the refrigerating chamber. The damper 10 may be closed if the temperature of the refrigerating chamber is equal to or less than the lower-limit temperature of the target temperature of the refrigerating chamber and is opened if the temperature of the refrigerating chamber is equal to or greater than the upper-limit temperature of the target temperature of the refrigerating chamber.

In addition, the controller 120 may change a speed of each of the switchable chamber fan 56 and the freezing chamber fan 66 according to the values sensed by the switchable chamber temperature sensor 130, the freezing chamber temperature sensor 140 and the refrigerating chamber temperature sensor 150. Each of the switchable chamber fan 56 and the freezing chamber fan 66 may be changed to a low-speed mode, a middle-speed mode and a high-speed mode.

In addition, the controller 120 may control the path switching device 110 to one of the plurality of modes.

The plurality of modes may include a simultaneous supply mode in which the path switching device 110 guides refrigerant to the pair of switchable chamber capillary tubes 7 and 8.

Figure 7:
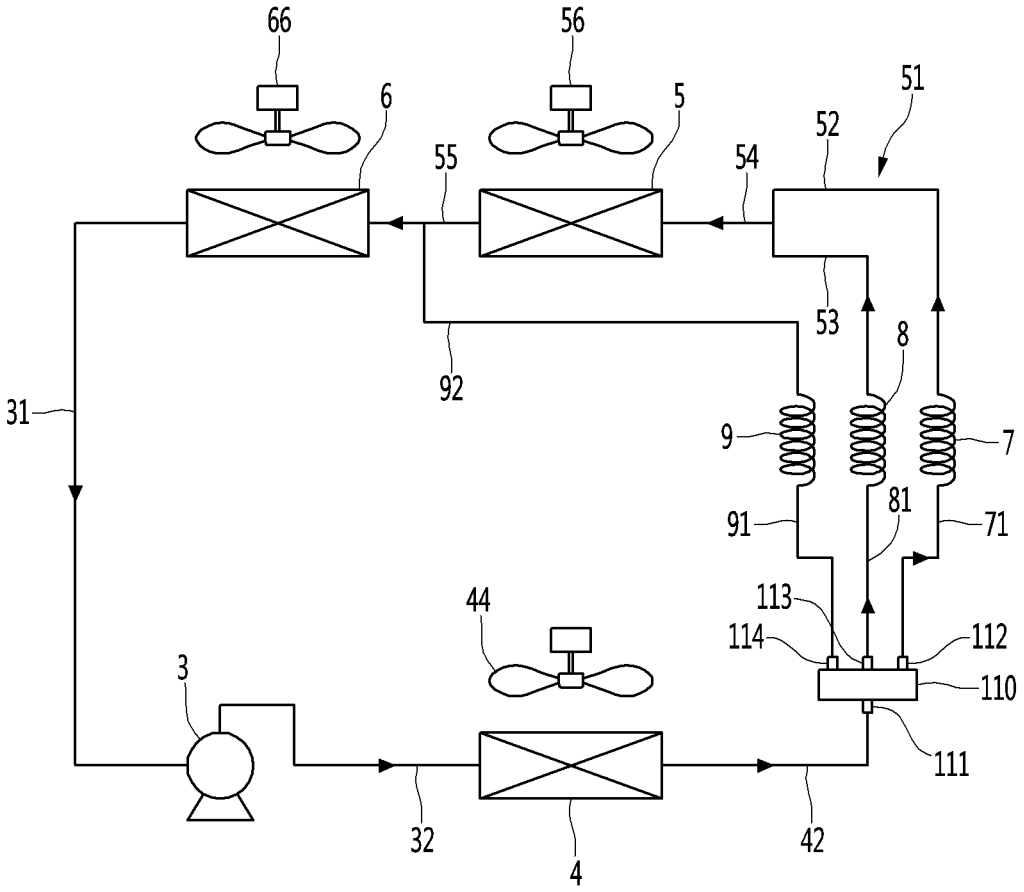
FIG. 7 is a view showing flow of refrigerant when the refrigerator according to the embodiment of the present disclosure is in a simultaneous supply mode.

The simultaneous supply mode may be a mode in which refrigerant is not guided to the bypass capillary tube 9 and is guided to the pair of switchable chamber capillary tubes 7 and 8, as shown in FIG. 7.

The controller 120 may control the path switching device 110 to the simultaneous supply mode, when the refrigerator starts up or is coping with a high load.

Start up of the refrigerator may mean the case in which power of the refrigerator is switched from OFF to ON. In this case, the controller 120 may control the path switching device 110 to the simultaneous supply mode.

An example of coping with the high load may include the case where the temperature of the switchable chamber increases to a temperature higher than the target temperature of the switchable chamber by a set temperature (e.g., 2° C.) after the switchable chamber door 13B is opened. When the temperature of the switchable chamber increases to the temperature higher than the target temperature of the switchable chamber by the set temperature after the switchable chamber door 13B is opened, the controller 120 may control the path switching device 110 to the simultaneous supply mode.

An example of coping with the high load may include the case where switchable chamber evaporator defrosting operation for defrosting the switchable chamber evaporator 5 is performed. The controller 120 may control the path switching device 110 to the simultaneous supply mode when defrosting operation terminates.

When the path switching device 110 is in the simultaneous supply mode and the compressor 3 is driven, the compressor 3 may compress and discharge refrigerant, and the refrigerant compressed in the compressor 3 may pass through the condenser 4 and then pass through the path switching device 110, thereby being distributed to the pair of switchable chamber capillary tubes 7 and 8 by the path switching device 110. In this case, the refrigerant may pass through the pair of switchable chamber capillary tubes 7 and 8, pass through the switchable chamber evaporator 5, and then pass through the freezing chamber evaporator 6, and eventually being sucked into the compressor 3.

In the simultaneous supply mode, the amount of refrigerant circulated in the switchable chamber evaporator 5 may increase, thereby increasing the cooling speed of the switchable chamber evaporator 5.

That is, the simultaneous supply mode may be performed when the switchable chamber C needs to be rapidly cooled, for example, the case where the refrigerator starts up or is coping with a high load.

Meanwhile, the plurality of modes may include a single supply mode in which the path switching device 110 supplies refrigerant to any one of the pair of switchable chamber capillary tubes 7 and 8. The single supply mode may be a mode in which refrigerant is guided to one of the pair of switchable chamber capillary tubes 7 and 8 without being guided to the other of the pair of switchable chamber capillary tubes 7 and 8 and the bypass capillary tube 9, as shown in FIG. 8.

When the path switching device 110 is in the single supply mode and the compressor 3 is driven, the compressor 3 may compress and discharge refrigerant, and the refrigerant compressed in the compressor 3 may pass through the condenser 4, pass through the path switching device 110, thereby being distributed to one 7 of the pair of switchable chamber capillary tubes 7 and 8 by the path switching device 110. In this case, the refrigerant may pass through one 7 of the pair of switchable chamber capillary tubes 7 and 8, pass through the switchable chamber evaporator 5, then pass through the freezing chamber evaporator 6, and eventually being sucked into the compressor 3.

The amount of refrigerant circulated in the switchable chamber evaporator 5 in the single supply mode is less than the amount of refrigerant circulated in the switchable chamber evaporator 5 in the simultaneous supply mode, and the refrigerator may gradually cool the switchable chamber C while an appropriate amount of refrigerant is supplied to the switchable chamber evaporator 5.

The single supply mode may be performed when the temperature of the switchable chamber is not in the satisfactory range, and not in the case where the refrigerator starts up or is coping with a high load.

An example of the satisfactory range of the temperature of the switchable chamber may be a temperature range between a lower-limit temperature (target temperature−1° C.) of a target temperature of the switchable chamber and an upper-limit temperature (target temperature+1° C.) of the target temperature of the switchable chamber.

Meanwhile, the plurality of modes may further include a bypass mode in which the path switching device 110 guides refrigerant to the bypass capillary tube 9. The bypass mode may be a mode in which refrigerant is not guided to the pair of switchable chamber capillary tubes 7 and 8, but is guided to the bypass capillary tube 9, as shown in FIG. 9.

When the path switching device 110 is in the bypass mode and the compressor 3 is driven, the compressor 3 may compress and discharge refrigerant, and the refrigerant compressed in the compressor 3 may pass through the condenser 4 and then pass through the path switching device 110, thereby being distributed to the bypass capillary tube by the path switching device 110. In this case, the refrigerant may pass through the bypass capillary tubes 9, bypass the switchable chamber evaporator 5 and pass through the freezing chamber evaporator 6, and eventually being sucked into the compressor 3.

The bypass mode may be performed when the temperature of the switchable chamber is in the satisfactory range and the temperature of the freezing chamber is in a dissatisfactory range, and not in the case where the refrigerator starts up or is coping with a high load.

An example of the satisfactory range of the temperature of the freezing chamber may be a temperature range between a lower-limit temperature (target temperature−1° C.) of a target temperature of the freezing chamber and an upper-limit temperature (target temperature+1° C.) of the target temperature of the freezing chamber.

In the bypass mode, since the refrigerant bypasses the switchable chamber evaporator 5 and flows into the freezing chamber evaporator 6, it is possible to rapidly solve the load of the freezing chamber F.

Figure 10:
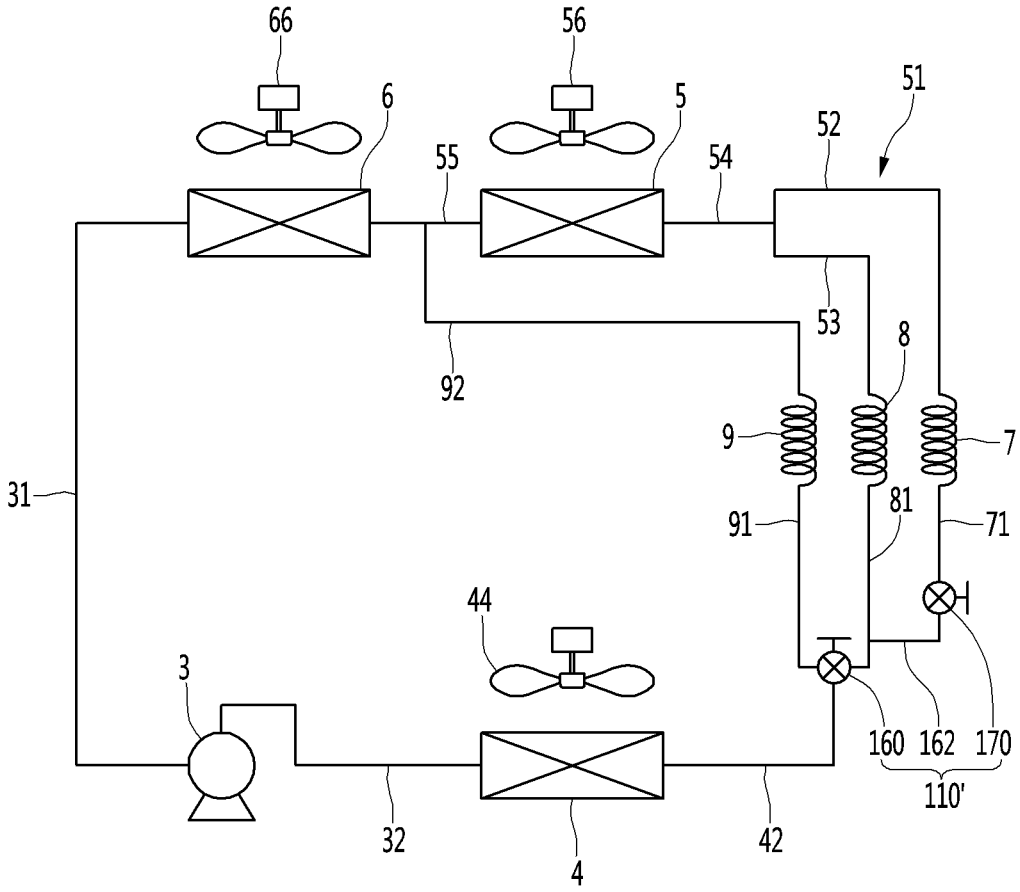
FIG. 10 is a diagram showing a configuration of a refrigerator according to another embodiment of the present disclosure.

FIG. 10 is a diagram showing a configuration of a refrigerator according to another embodiment of the present disclosure.

The path switching device 110' of the refrigerator of the present embodiment may include a plurality of valves 160 and 170, as shown in FIG. 10. In this case, the plurality of valves 160 and 170 may include a first valve 160 and a second valve 170.

The first valve 160 may be connected with a bypass capillary tube 9. The first valve 160 may be a bypass valve for determining whether or not refrigerant flows to the bypass capillary tube 9 and the second valve 170. The first valve 160 may be connected to the second valve 170. The first valve 160 may be composed of a three-way valve.

The first valve 160 may be controlled to a bypass mode in which refrigerant is guided to the bypass capillary tube 9 and a switchable chamber supply mode in which refrigerant is guided to one of the pair of switchable chamber capillary tubes 7 and 8 and the second valve 170.

The second valve 170 may be connected to any one 7 of the pair of switchable chamber capillary tubes 7 and 8. The second valve 170 may be composed of an electromagnetic valve such as a solenoid valve.

When the first valve 160 is in a switchable chamber supply mode and the second valve 170 is opened, refrigerant may flow to the switchable chamber evaporator 5 through the pair of switchable chamber capillary tubes 7 and 8. In this case, the path switching device 110' may be in the simultaneous supply mode of the embodiment of the present disclosure.

When the first valve 160 is in a switchable chamber supply mode and the second valve 170 is closed, refrigerant may flow to the switchable chamber evaporator 5 through only one 8 of the pair of switchable chamber capillary tubes 7 and 8. In this case, the path switching device 110' may be in the single supply mode of the embodiment of the present disclosure.

The first valve 160 may be connected to the condenser discharging path 42. The first valve 160 may be connected to the third inlet path 91 to guide refrigerant to the bypass capillary tube 9 through the third inlet path 91.

The first valve 160 may be connected to the one 8 of the pair of switchable chamber capillary tubes 7 and 8 through the second inlet path 81.

The second valve 170 may be connected to the second inlet path 81 through a valve connection path 162. The first valve 160 may guide refrigerant to the second valve 170 through the valve connection path 162.

The second valve 170 may be connected to the first inlet path 71 to guide refrigerant to one 7 of the pair of capillary tubes 7 and 8 through the first inlet path 71.

The other configuration and operation of the path switching device 110' of the present embodiment are equal or similar to those of the above-described embodiment of the present disclosure and are denoted by the same reference numerals, and thus a detailed description thereof will be omitted.

Figure 11:
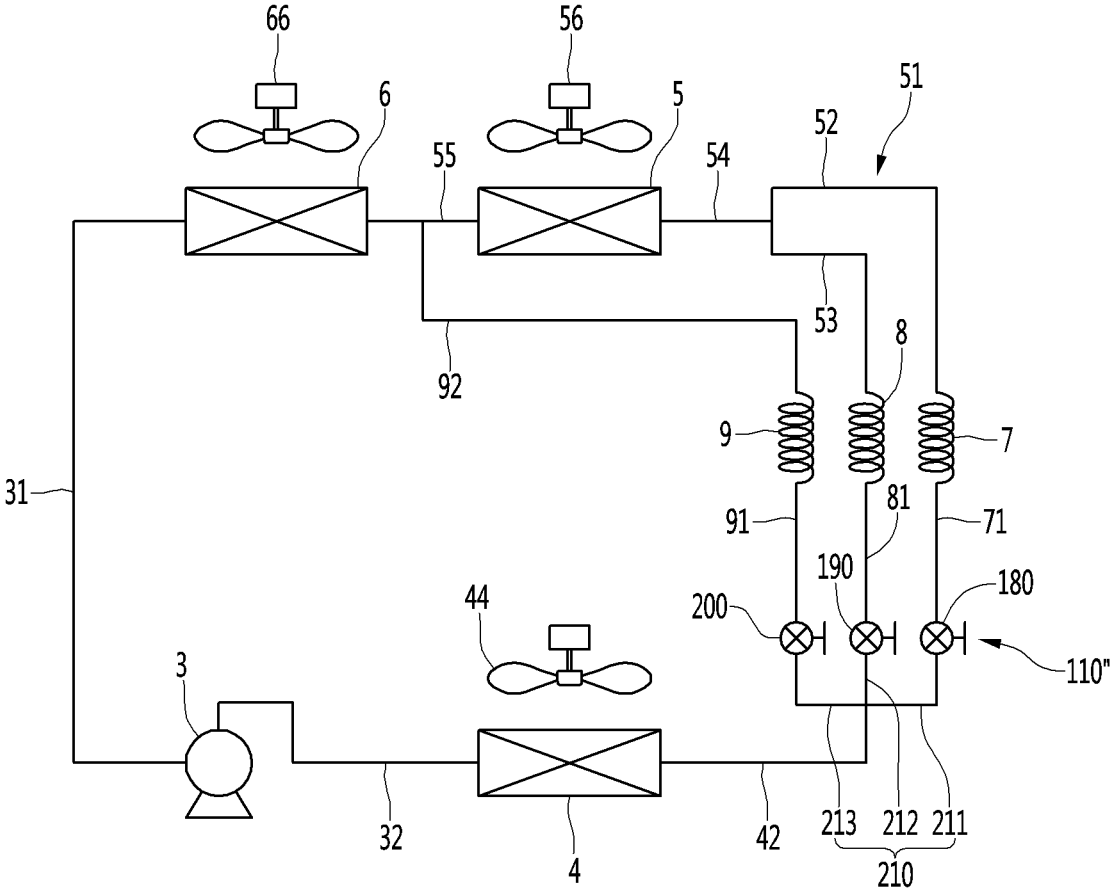
FIG. 11 is a diagram showing a configuration of a refrigerator according to another embodiment of the present disclosure.

FIG. 11 is a diagram showing a configuration of a refrigerator according to another embodiment of the present disclosure.

The path switching device 100" of the refrigerator of the present embodiment may include three valves. In this case, the three valves may include a first control valve 180 connected to one of the pair of capillary tubes 7 and 8, a second control valve 190 connected to the other of the pair of capillary tubes 7 and 8, and a third control valve 200 connected to the bypass capillary tube 9.

The first control valve 180, the second control valve 190 and the third control valve 200 may be connected to the condenser discharging path 42 through a branch path 210.

The branch path 210 may include a first branch path 211 connecting the condenser discharging path 42 with the first control valve 180, a second branch path 212 connecting the condenser discharging path 42 with the second control valve 190, and a third branch path 213 connecting the condenser discharging path 42 with the third control valve 200.

The first control valve 180 may be connected with the first inlet path 71 to guide refrigerant to the first switchable chamber capillary tube 7 through the first inlet path 71.

The second control valve 190 may be connected with the second inlet path 81 to guide refrigerant to the second switchable chamber capillary tube 8 through the second inlet path 81.

The third control valve 200 may be connected with the third inlet path 91 to guide refrigerant to the bypass capillary tube 9 through the third inlet path 91.

The other configuration and operation of the path switching device 110" of the present embodiment are equal or similar to those of the above-described embodiment of the present disclosure and are denoted by the same reference numerals, and thus a detailed description thereof will be omitted.

According to the embodiments of the present disclosure, since the amount of refrigerant circulated in the switchable chamber evaporator may be increased by the pair of capillary tubes, it is possible to more rapidly cool the switchable chamber and the freezing chamber. In addition, since refrigerant may be supplied to one of the pair of capillary tubes or the bypass capillary tube, it is possible to optimally control the temperatures of the switchable chamber and the freezing chamber.

The above-disclosed subject matter is to be considered illustrative, and not restrictive, and the appended claims are intended to cover all such modifications, enhancements, and other embodiments, which fall within the scope of the present disclosure.

Thus, the embodiment of the present disclosure is to be considered illustrative, and not restrictive.

Therefore, the scope of the appended claims is defined not by the detailed description of the invention, and all differences within the scope will be construed as being included in the appended claims.

What is claimed is:

1. A refrigerator comprising:

a main body having a freezing chamber, a switchable chamber and a refrigerating chamber, the refrigerating chamber being configured to communicate with both the freezing chamber and the switchable chamber;

a duct including a first conduit communicating with the switchable chamber, a second conduit communicating with the freezing chamber, a third conduit communicating with the refrigerating chamber and a barrier provided between the first conduit and the second conduit to block a flow of air between the first conduit and the second conduit;

a compressor connected with a compressor suction path and a compressor discharging path to compress refrigerant;

a condenser connected with the compressor discharging path and connected with a condenser discharging path;

a switchable chamber evaporator to cool the switchable chamber;

a freezing chamber evaporator connected with the switchable chamber evaporator through an evaporator connection path to cool the freezing chamber;

a damper provided in the duct, the damper being configured to be movable from an open mode to a closed mode;

a pair of switchable chamber capillary tubes connected with the switchable chamber evaporator;

a bypass capillary tube connected with the evaporator connection path;

a valve connected with the condenser discharging path, the pair of switchable chamber capillary tubes and the bypass capillary tube, wherein the switchable chamber capillary tubes are connected to outlet ports of the valve and are commonly connected with the switchable chamber evaporator through a common path; and a controller to control the compressor, the damper and the valve, wherein in the open mode, the controller controls the damper such that the damper moves to allow each of the first and second conduits to communicate with the third conduit, thereby introducing the air in the switchable chamber and the freezing chamber into the refrigerating chamber, and wherein in the closed mode, the controller controls the damper such that the damper moves to allow the third conduit to be closed and prevent the air in the switchable chamber and the freezing chamber from being introduced into the refrigerating chamber.

2. The refrigerator of claim 1, wherein the pair of switchable chamber capillary tubes is connected with the valve and is connected with the switchable chamber evaporator through a joint path.

3. The refrigerator of claim 1, wherein each of the pair of switchable chamber capillary tubes is of equal capacity.

4. The refrigerator of claim 1, wherein the barrier is spaced apart from the third conduit and under the third conduit in a vertical direction.

5. The refrigerator of claim 1, wherein the barrier has a horizontal width decreasing toward the top.

6. The refrigerator of claim 1, wherein the barrier has a cold air guide surface formed to become increasingly sloped from the bottom toward the top.

7. The refrigerator of claim 1, wherein first and second surfaces of the barrier are recessed.

8. The refrigerator of claim 1, wherein the first surface of the barrier forms a surface of the first conduit to guide the air of the switchable chamber to flow toward the third conduit, and wherein the second surface of the barrier forms a surface of the second conduit to guide the air of the freezing chamber to flow toward the third conduit.

9. The refrigerator of claim 1, wherein the damper includes a path body and a damper body, the damper body opening or closing a passage of the path body.

10. The refrigerator of claim 9, wherein the damper further comprises a motor, and the damper body is rotatably connected with the path body, the motor controlled by the controller to rotate the damper body to open or close the passage of the path body.

11. The refrigerator of claim 1, wherein the valve includes a four-way valve including:

an inlet port connected with the condenser discharging path;

a first outlet port connected with one of the pair of capillary tubes;

a second outlet port connected with an other of the pair of capillary tubes; and a third outlet port connected with the bypass capillary tube.

12. The refrigerator of claim 1, further comprising:

a switchable chamber fan to blow the air of the switchable chamber to flow to the switchable chamber evaporator and to blow the air in the switchable chamber and to the duct; and a freezing chamber fan to blow the air of the freezing chamber to flow to the freezing chamber evaporator and to blow the air in the freezing chamber and to the duct.

13. The refrigerator of claim 12, further comprising:

a switchable chamber temperature sensor to sense a temperature of the switchable chamber;

a freezing chamber temperature sensor to sense a temperature of the freezing chamber; and a refrigerating chamber temperature sensor to sense a temperature of the refrigerating chamber, wherein the controller controls a speed of each of the switchable chamber fan and the freezing chamber fan based on values sensed by the switchable chamber temperature sensor, the freezing chamber temperature sensor and the refrigerating chamber temperature sensor.

14. The refrigerator of claim 1, wherein the controller is configured to control the valve based on a plurality of modes, the plurality of modes including:

a simultaneous supply mode in which the valve guides the refrigerant to the pair of switchable chamber capillary tubes and prevents the refrigerant from flowing into the bypass capillary tube;

a single supply mode in which the valve guides the refrigerant to one of the pair of switchable chamber capillary tubes and prevents the refrigerant from flowing into the other one of the pair of switchable chamber capillary tubes and bypass capillary tube; and a bypass mode in which the valve guides refrigerant to the bypass capillary tube and prevents the refrigerant from flowing into the pair of switchable chamber capillary tubes.

15. The refrigerator of claim 14, wherein the controller controls the valve to the simultaneous supply mode when the refrigerator starts up or is coping with a high load.

16. The refrigerator of claim 14, wherein the controller controls the valve to the single supply mode when a temperature of the switchable chamber is above a target temperature.

17. The refrigerator of claim 14, wherein the controller controls the valve to the bypass mode when a temperature of the freezing chamber is above a first target temperature and a temperature of the switchable chamber is below a second target temperature.

* * * * *